US008579284B2

(12) United States Patent
Herrmann et al.

(10) Patent No.: US 8,579,284 B2
(45) Date of Patent: Nov. 12, 2013

(54) PNEUMATIC SHEET REGISTRATION AND CLAMPING

(75) Inventors: Douglas K. Herrmann, Webster, NY (US); James Joseph Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/432,255

(22) Filed: Mar. 28, 2012

(65) Prior Publication Data

US 2013/0256972 A1 Oct. 3, 2013

(51) Int. Cl.
*B65H 29/24* (2006.01)
*B65H 9/00* (2006.01)

(52) U.S. Cl.
USPC ..... 271/236; 271/195

(58) Field of Classification Search
CPC ..... B65H 9/103; B65H 9/105
USPC ..... 271/236, 195, 194; 414/676; 269/21, 24
See application file for complete search history.

(56) References Cited

U.S. PATENT DOCUMENTS

| | | | | | |
|---|---|---|---|---|---|
| 1,669,556 | A | | 5/1928 | Gollnick et al. | |
| 3,918,706 | A | * | 11/1975 | Craft | 271/250 |
| 4,055,340 | A | | 10/1977 | Stange et al. | |
| 4,066,254 | A | * | 1/1978 | Stange et al. | 271/236 |
| 4,090,704 | A | * | 5/1978 | Smith et al. | 271/246 |
| 4,116,431 | A | * | 9/1978 | Stange et al. | 271/236 |
| 4,130,274 | A | * | 12/1978 | Stange | 271/236 |
| 4,171,131 | A | * | 10/1979 | Stange et al. | 271/236 |
| 4,371,309 | A | | 2/1983 | Principe et al. | |
| 4,648,779 | A | | 3/1987 | Weitzman | |
| 4,702,664 | A | * | 10/1987 | Lukens, Jr. | 414/676 |
| 4,840,697 | A | | 6/1989 | Goodfellow et al. | |
| 5,203,246 | A | | 4/1993 | Smitterberg et al. | |
| 5,215,302 | A | | 6/1993 | Bedzyk | |
| 6,296,244 | B1 | | 10/2001 | Hanks et al. | |
| 6,505,831 | B2 | * | 1/2003 | Henn et al. | 271/227 |
| 6,540,001 | B1 | * | 4/2003 | McNestry | 156/541 |
| 8,196,307 | B2 | * | 6/2012 | Kagi et al. | 33/623 |
| 2005/0062220 | A1 | * | 3/2005 | Cardillo et al. | 271/236 |
| 2010/0148428 | A1 | * | 6/2010 | Kagi et al. | 271/227 |

* cited by examiner

*Primary Examiner* — Kaitlin Joerger
(74) *Attorney, Agent, or Firm* — Hoffmann & Baron, LLP

(57) ABSTRACT

Disclosed is a pneumatic table for registering a substrate media sheet. The table including a media platen, a reversible air blower, a registration wall and a sheet biasing element. The media platen having a foraminous upper surface for received the sheet. The reversible air blower selectively generating at least one of a positive air flow and a negative airflow through the foraminous upper surface. The positive air flow forming a gaseous layer of air between the foraminous upper surface and the sheet. The negative airflow encouraging the sheet to remain fixed and engaged upon the foraminous upper surface. The registration wall extending along at least one edge of the foraminous upper surface. The sheet biasing element selectively applying a horizontal biasing force to the sheet encouraging movement of the sheet across the foraminous upper surface for engaging the sheet with the registration wall.

18 Claims, 5 Drawing Sheets

PNEUMATIC SHEET REGISTRATION AND CLAMPING

TECHNICAL FIELD

The present disclosure relates to an apparatus for and method of registering and clamping sheets of substrate media transported on a moveable platen in a printing system.

BACKGROUND

High speed inkjet marking devices for large sized cut sheets are particularly constrained using contemporary systems with regard to production output, media type and image quality. Systems that handle such large sized cut sheets can use an oversized media platen to support the sheet during the marking process, but placement and registration of the sheet on the platen requires precision. Also, once the sheet is moved into the desired registration position, that position must be reliability maintained. However, such large sheets are particularly difficult to manipulate into and maintain in proper registration upon the platen, particularly if it is a moveable platen.

Accordingly, it would be desirable to provide an apparatus for and method of registering and clamping a sheet of substrate media on a media platen for handling in a printing system that overcomes the various shortcomings of the prior art.

SUMMARY

According to aspects described herein, there is disclosed an apparatus forming a pneumatic table for registering and clamping thereon a sheet of substrate media for handling in a printing system. The pneumatic table includes a media platen, a reversible air blower, a registration wall and a sheet biasing element. The media platen having a foraminous upper surface for receiving a substrate media sheet. The reversible air blower selectively generating at least one of a positive air flow and a negative airflow through the foraminous upper surface. The positive air flow forming a gaseous layer of air between the foraminous upper surface and the substrate media sheet. The negative airflow encouraging the substrate media sheet to remain fixed and engaged upon the foraminous upper surface. The registration wall extending along at least one edge of the foraminous upper surface. The sheet biasing element selectively applying a horizontal biasing force to the substrate media sheet encouraging movement of the substrate media sheet across the foraminous upper surface for engaging the substrate media sheet with the registration wall.

Additionally, the reversible air blower can be configured to provide a virtually instantaneous transition from positive air flow to negative air flow. Alternatively, the reversible air blower can be configured to provide a progressive transition across the foraminous upper surface from positive air flow to negative air flow. The pneumatic table can further include an edge sensor for detecting a position of the substrate media sheet. The edge sensor disposed along a portion of the registration wall for detecting the substrate media sheet has attained a target registration position. The registration wall can extend along two adjoining edges of the foraminous upper surface. The registration wall can also extend continuously along the at least one edge substantially as long as at least one edge of the substrate media sheet. At least a portion of the registration wall can be selectively moveable in order to allow the substrate media sheet to slide off the foraminous upper surface. The sheet biasing element can include a mechanical element directly engaging the substrate media sheet in order to encourage the movement thereof. Also, the sheet biasing element can include an at least partially horizontal stream of air jetting across a surface of the substrate media sheet. Additionally, the sheet biasing element can include a tilt assembly configured to tilt the foraminous upper surface allowing gravity to supply the horizontal biasing force as part of a down-hill sliding force across the foraminous upper surface. Further, the sheet biasing element can directly engage the substrate media sheet on at least one edge.

According to further aspects described herein, there is disclosed a method of registering and securing a sheet of substrate media on a media platen for handling in a printing system. The method includes loading a substrate media sheet onto a media platen. The media platen including a foraminous upper surface for engaging the substrate media sheet. Also, generating a positive flow of air through the foraminous upper surface. The positive flow of air forming a gaseous layer of air between the foraminous upper surface and the substrate media sheet. The method further includes applying a generally horizontal biasing force to the substrate media sheet at least partially suspended on the gaseous layer. Additionally; the method includes generating a negative flow of air through the foraminous upper surface. The negative flow of air encouraging the substrate media sheet to remain fixed and engaged upon the foraminous upper surface.

Additionally, the negative flow of air can be generated in response to the positive flow of air no longer passing through at least a portion of the foraminous upper surface that previously had the positive flow of air passing therethrough. Also, a virtually instantaneous transition can be provided from the generation of the positive flow of air to the generation of the negative flow of air. A progressive transition across the foraminous upper surface can alternatively be provided from the generation of the positive flow of air to the generation of the negative flow of air. The negative flow of air can be generated in response to an indication by a sensor that the substrate media sheet has engaged a registration wall extending along at least one edge of the foraminous upper surface. The registration wall engagement can include the substrate media engaging two extents of the registration wall. The two extents of the registration wall can be disposed along two adjoining edges of the foraminous upper surface. The generally horizontal biasing force can be applied by a mechanical element directly engaging the substrate media sheet in order to encourage the movement thereof. Also, the generally horizontal biasing force can be applied by at least one substantially horizontal stream of air jetting across a surface of the substrate media sheet. The at least one substantially horizontal stream can include at least two different streams of air having different mean directional vectors of biasing force. Alternatively, the generally horizontal biasing force can be applied by a tilt assembly configured to tilt the foraminous upper surface allowing gravity to supply the horizontal biasing force as part of a down-hill sliding force across the foraminous upper surface. Also, the progressive transition can include switching select regions of the foraminous upper surface separately from positive to negative flow of air.

DETAILED DESCRIPTION

Figure 1:
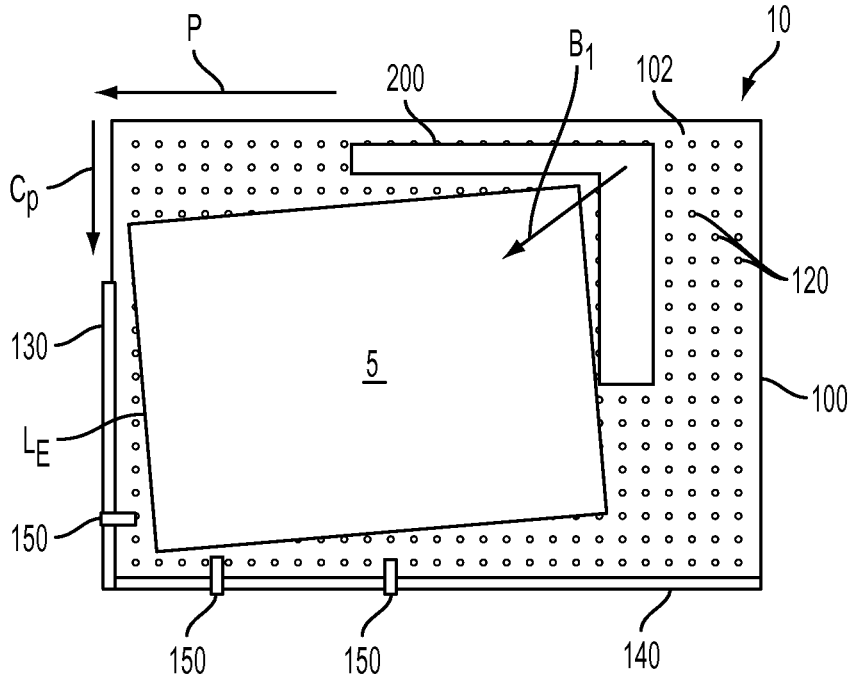
FIG. 1 is a plan view of a pneumatic table for registering and transporting a skewed sheet of substrate media being biased toward a registration corner in accordance with an aspect of the disclosed technologies.

Describing now in further detail these exemplary embodiments with reference to the Figures. The disclosed technologies improve image quality for large format print jobs, while providing an efficient sheet registration and handling system that can improve productivity. The apparatus and methods disclosed herein can be used in a select location or multiple locations of a marking device path that includes a pneumatic table. Thus, only a portion of an exemplary pneumatic table and methods of use thereof are illustrated herein.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, "sensor" refers to a device that responds to a physical stimulus and transmits a resulting impulse in the form of a signal for the measurement and/or operation of controls. Such sensors include those that use pressure, light, motion, heat, sound and magnetism. Also, each of such sensors as refers to herein can include one or more sensors for detecting and/or measuring characteristics of a substrate media, such as speed, orientation, process or cross-process position and even the size of the substrate media. Thus, reference herein to a "sensor" can include more than one sensor.

As used herein, "marking zone" refers to the location in a substrate media processing path in which the substrate media is altered by a "marking device." Marking devices as used herein include a printer, a printing assembly or printing system. Such marking devices can use digital copying, bookmaking, folding, stamping, facsimile, multi-function machine, and similar technologies. Particularly those that perform a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, the terms "process" and "process direction" refer to a process of moving, transporting and/or handling a substrate media sheet. The process direction substantially coincides with a direction of a flow path P along which a portion of the media sled moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

FIG. 1 shows a plan view of a pneumatic table 10 for registering and clamping a sheet of substrate media 5 placed thereon. When printing a sheet, such as a sheet of paper, on a media platen, precise registration of the sheet must be accomplished before the sheet can be marked or further processed. The media platen generally formed as a flat rigid plate for supporting the substrate media sheet. Generally the media platen can be a flat metal surface which will support the sheet when pressure is applied thereto, particularly as part of a printing process using marking devices. As shown, the sheet 5 when placed on the platen 100 may be skewed and/or improperly positioned on the platen 100. Thus, according to an aspect of the disclosed technologies, it is desirable to have the sheet 5 properly registered relative to a process direction P as well as a cross-process direction $C_T$. A preferred registration position for the leading edge $L_E$ of the sheet 5 is when it is precisely aligned with the downstream edge of the media platen 100. That edge of the media platen 100 coincides with a side of the leading edge registration wall 130. Thus, by bringing the leading edge $L_E$ of the sheet 5 into engagement with the leading edge registration wall 130 the first part of the target registration position is achieved. Similarly, a preferred registration position for the left side lateral edge of the sheet 5 (the bottom edge as shown in the drawings) is when that sheet edge is aligned with the outboard edge of the media platen 100 (also the bottom edge as shown in the drawings). Thus, by also bringing the left lateral sheet edge into engagement with the lateral edge registration wall 140 the second part of the target registration position is achieved. The order, if any, in which these parts of the position are achieved is a matter of design choice and depends on how the sheet is moved into the target registration position.

In accordance with a further aspect of the disclosed technologies, the pneumatic table 10 includes a media platen 100 that has a foraminous upper surface 102. The pneumatic table 10 operates by means of air, particularly compressed air, that can be expelled through the foraminous upper surface 102 or the flow reversed to create a vacuum force on the foraminous upper surface 102. The foraminous upper surface can be porous, perforated or otherwise include numerous holes so that air can be expelled from the foraminous upper surface 102 of the media platen 100. In the illustrated embodiment, the foraminous upper surface 102 includes a plurality of air holes 120 that are evenly distributed in columns and rows across the top surface of the media platen 100. It should be understood that other configurations of air holes 120 could be provided, so that fewer or greater numbers of such holes can form the foraminous upper surface. Additionally, other patterns could be formed, such as concentric arches emanating from the corner between the two registration walls 130, 140. Also, the air holes 120 need not be evenly space across the entire surface. As an alternative to the air holes 120, the foraminous upper surface 102 could be a generally porous surface with less discrete apertures. Regardless, the discrete air holes 120 or less than discrete apertures forming a porous surface are preferably in fluid communication with at least one reversible air blower that provides a source of selectively positive and/or negative air flow for the pneumatic table 10.

Figure 2:
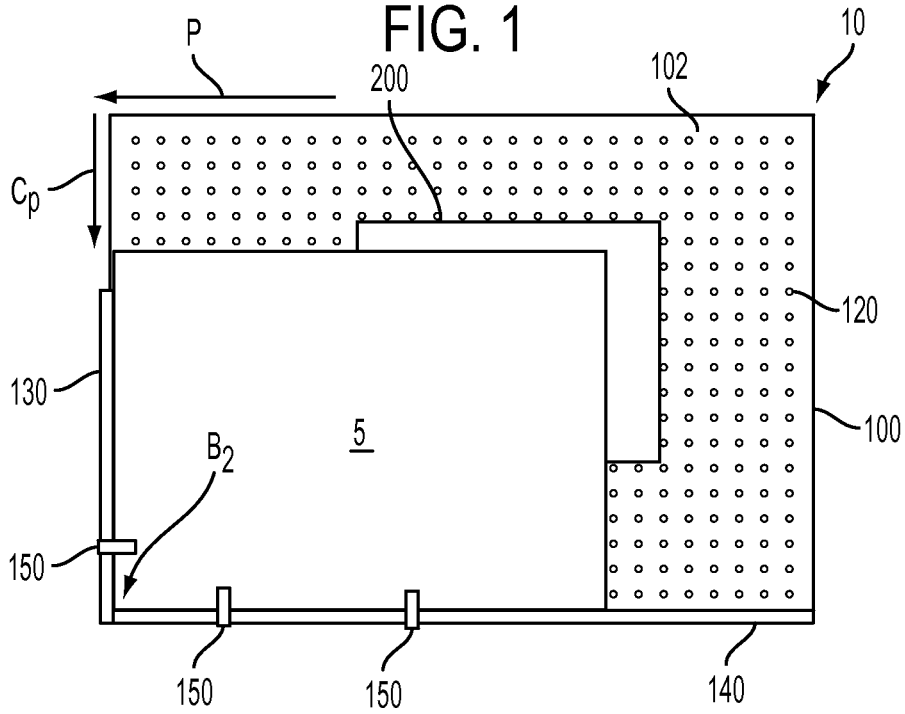
FIG. 2 is a plan view of the pneumatic table shown in FIG. 1 with a de-skewed sheet of substrate media biased into a registered orientation in accordance with an aspect of the disclosed technologies.

Once a sheet 5 is placed on the pneumatic table 10, positive air flow emitted from the foraminous upper surface 102 will cause the sheet 5 to float on a gaseous layer of air formed between the upper surface 102 and the sheet 5. It should be understood that the positive air flow can be emitted before, during or after the sheet 5 is placed on the pneumatic table 10. The gaseous layer of air reduces friction or electrostatic forces that might otherwise hold the sheet 5 in a skewed or otherwise disoriented position on the platen. In accordance with an aspect of the disclosed technologies, when the sheet 5 is floating due to the positive airflow, a horizontal biasing force $B_1$ is applied to the floating sheet 5. Preferably, the horizontal biasing force $B_1$ encourages the sheet 5 to move towards both registration walls 130, 140. Such a biasing force $B_1$ can be implemented by way of a sheet biasing element 200. Once the sheet 5 is engaged against both the leading edge registration wall 130 and the lateral edge registration wall 140, it will have attained the target registration position, as shown in FIG. 2. The registration walls 130, 140 can extend across an entire extent of each of the respective platen edges, such as the lateral wall 140 or extend across a more limited extent, such as the lead edge wall 130. Also the walls 130, 140 can be continuous solid walls or include apertures for allowing extraneous air flow to pass therethrough.

FIGS. 1 and 2 illustrate a sheet biasing element 200 in the form of a moveable mechanical barrier having a right angle for engaging and pushing two adjacent edges of the substrate sheet 5. While one of two engagement edges of the sheet biasing element 200 might engage the sheet earlier than the other engagement edge, as shown in FIG. 2 eventually both engagement edges will ensure that the sheet 5 is properly registered against both registration walls 130, 140. The biasing element 200 can include two vertical walls designed to engage two adjoining edges of the sheet 5. The fact that the sheet 5 should be floating slightly above the platen surface, as a result of the positive airflow from the foraminous upper surface 102, should prevent the sheet 5 from getting wedged under the biasing element 200. It should be understood that a different biasing element 200 can be provided, as desired for the particular application. For example, the biasing element can take the form of a steerable driven engagement roller selectively applied to an upper surface of the sheet 5. Once engaged with the sheet 5, a driven roller can apply a biasing force $B_1$ through a frictional engagement with the top surfaces of the sheet 5. As yet a further alternative, the biasing element 200 can take the form of one or more nozzle assemblies for applying an at least partially horizontal stream of air from the top side the sheet 5 in the direction of the desired biasing force $B_1$. Also, the biasing element 200 can be formed by two separate elements, such as two separate guide walls, one extending in a process direction and another extending in a cross process direction. Further, one or more slideable guide pins extending vertically perpendicular to the platen surface but moveable toward the registration walls 130, 140 can be used as a biasing element 200 that provides a biasing force $B_1$. Further still, a biasing force $B_1$ can provided by tilting the platen 100, such that the upper surface 102 is no longer level, but rather tilted dowwardly in the direction of the desired biasing force. In this way, what ever biasing element is used, it should be able to apply a selective, adjustable and/or even variable biasing force to a sheet of substrate media 5.

The horizontal biasing force $B_1$ will understandably have a mean directional vector. In this regard, while the direction of this initial force $B_1$ should generally be toward the corner adjoining the two registration walls 130, 140, the amount of force can vary depending on factors such as the size and weight of the substrate media sheet 5. Also, it should be understood that a secondary biasing force $B_2$ can optionally be applied after the initial biasing force $B_1$ to finish encouraging the sheet 5 into that target registration position. Such an alternative or secondary biasing force $B_2$ would have a different mean directional vector from the initial biasing force $B_1$. It should further be understood that one or more further biasing forces including a rotational force could be applied to the sheet, if desired. Once the sheet 5 is in the target registration position, edge sensors 150 can be used to confirm this registration state. Such edge sensors preferably detect the absence or presence of a substrate media sheet in relation to the sensor 150. In this case, the presence of the sheet 5 under all three edge sensors 150 provides an indication that the sheet 5 has reached the target registration position.

Additionally, the horizontal biasing forces described herein can be applied to the sheet 5 by various means. For example, a mechanical element such as a nudger wall, moveable pin or drive roller can be used to directly engage the sheet 5 in order to impart a biasing force. Alternatively, a stream of air jetting across a top surface of the sheet 5 could bias the sheet into registration. Such a stream of air could also have a downward component to it in order to help hold-down the sheet while moving into the registration position. The horizontal stream of air can be a steady stream or intermittent puffs of air, to help nudge the sheet into position. Also, as yet a further alternative the pneumatic table 10 can be configured to tilt. By tilting the table 10 such that the corner of the two registration walls 130, 140 is the lowest point on the table 10, gravity will bias the sheet toward the target registration position.

The pneumatic table and methods described herein are particularly useful for handling large size substrate media sheets. In particular, large size paper having dimensions of 62"×42" can be easily accommodated by the disclosed technologies. What is more, larger sheets can be handled as long as the media platen 100 is sized accordingly.

Additionally, it should be understood that the pneumatic table 10 disclosed herein can be operated in conjunction with a controller (now shown). The controller may also control any number of functions and systems within or associated with the pneumatic table 10 and accompanying marking systems. The controller may include one or more processors and software capable of generating control signals. Through the coordinated control of the apparatus sub-elements, including the reversible air blower, horizontal biasing elements and sensors, the substrate media sheet may be effectively handled and marked. Further, it should be understood that the controller can also operate related items such as a sheet loader for initially placing the substrate media sheet onto the pneumatic table 10. Such a sheet loader can take the form of a 6-axis adept robot system for picking and placing sheets, such as large sheets of substrate media, on the media platen 100.

Figure 3:
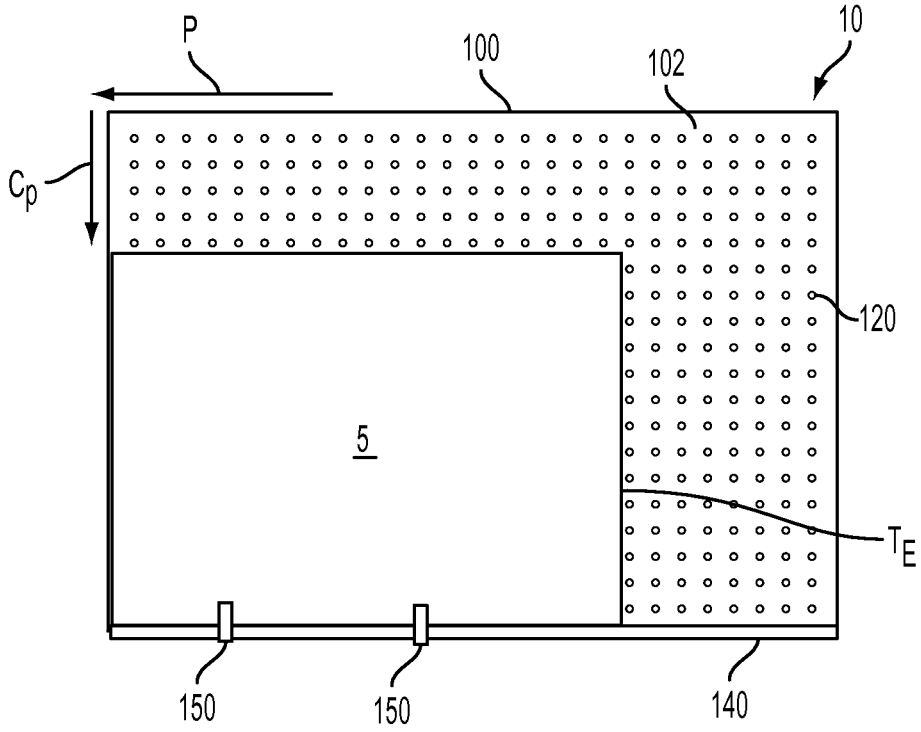
FIG. 3 is a plan view of the pneumatic table shown in FIG. 1 with the sheet of substrate media registered and clamped in accordance with an aspect of the disclosed technologies.

Once the sheet 5 reaches the target registration position as shown in FIGS. 2 and 3, the reversible air blower will switch from generating positive air flow to generating a vacuum force (also referred to herein as a negative air flow). Such negative air flow provides a suction force encouraging the substrate media sheet to remain fixed and engaged with the foraminous upper surface. According to one aspect of the disclosed technologies, the switch between positive air flow and negative air flow can be a virtually instantaneous transition. It should be understood, however, that such an instantaneous transition might be limited by the particular reversible blower chosen for the system. Nonetheless, it is desirable that the transition be as quick as possible so that the substrate media sheet 5 stays in the target registration position and remains there when the negative air flow is applied. As a further alternative the transition between positive and negative air flow can be provided progressively across the foraminous upper surface. In this way, only some of the air holes 120 will initially switch-over to negative air flow, followed by a greater number of air holes 120, until the air holes under the sheet 5 no longer have any positive air flow emitting from them. For example, the left hand column of air holes 120 can initially switch to have negative air flow and additional columns progressing towards the sheet trailing edge $T_E$ can then switch over from positive air flow to negative air flow. Once a sufficient amount of the sheet 5 is held down by negative air flow, the remainder of the foraminous upper surface can be made to switch completely over to negative air flow.

Figure 4:
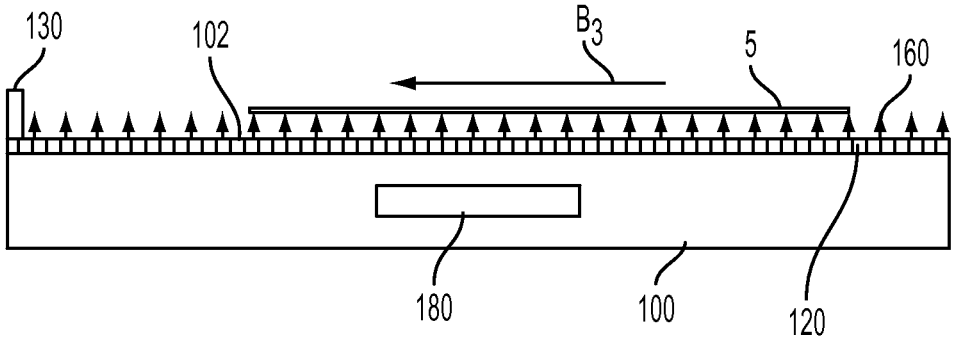
FIG. 4 is a side cross-sectional elevation view of the pneumatic table shown in FIG. 1 with positive airflow through the table platen in accordance with an aspect of the disclosed technologies.
Figure 5:
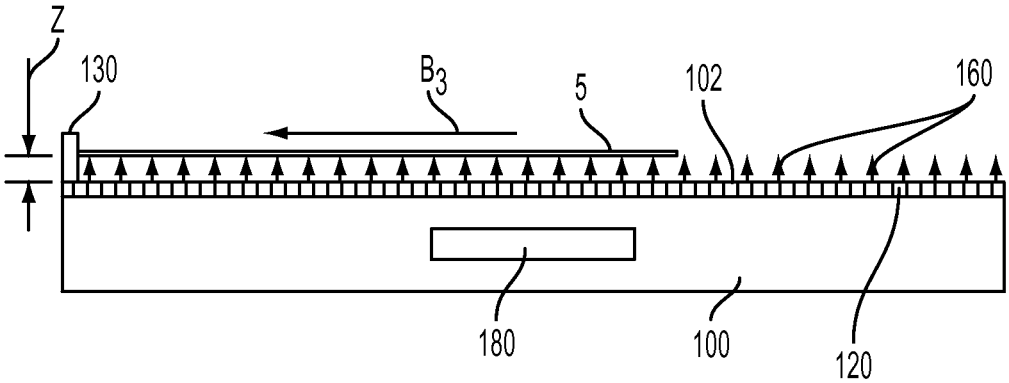
FIG. 5 is a side cross-sectional elevation view of the pneumatic table shown in FIG. 2 with positive airflow through the table platen in accordance with an aspect of the disclosed technologies.
Figure 6:
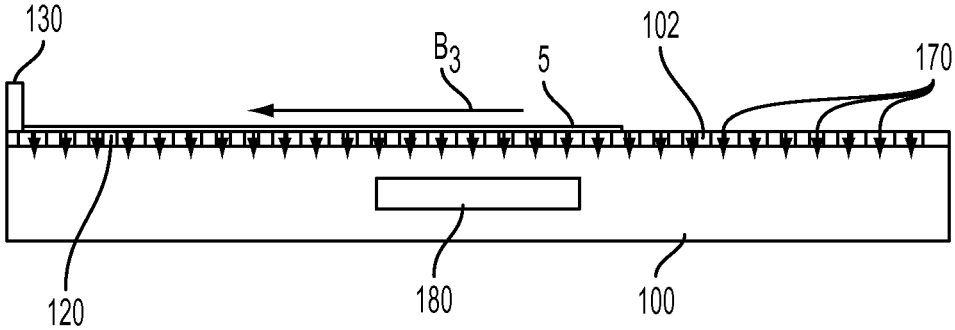
FIG. 6 is a side cross-sectional elevation view of the pneumatic table shown in FIG. 2 with negative airflow through the table platen in accordance with an aspect of the disclosed technologies.

FIGS. 4-6 show a side cross-sectional elevation view of the pneumatic table shown in FIGS. 1-2. These side views include a schematic representation of the reversible air blower 180, which represents any device capable of producing a current of air or gas, selectively in at least two directions. Provided appropriate tubing channels or conduits (not shown) between the air holes 120 and the reversible air blower 180 will place the air holes 120 in fluid communication with the reversible air blower 180. In this way, any air blowing from the reversible air blower will exit the air holes in the foraminous upper surface 102 or vacuum force generated will communicate a suction force on that upper surface 102.

FIG. 4 represents an initial placement position of the sheet 5 similar to that shown in FIG. 1. It should be understood that in FIGS. 4-5, the horizontal biasing force $B_3$ is distinguished from that shown in FIGS. 1 and 2 because it is only representing a process direction biasing force or at least the process direction component of a biasing force. A positive air flow 160 is shown emitting from the upper surface 102. Also, the gap Z between the sheet 5 and the upper surface 102 is filled with a gaseous layer causing the sheet 5 to float above the upper surface. FIG. 6 shows a negative air flow 170 pulling from the foraminous upper surface 102. The negative air flow 170 clamps the sheet 5 down into direct engagement with the upper surface 102 through the suction force generated by the blower 180.

Once the sheet 5 is clamped in the target registration position, it is ready for marking or further processing by a printing system. A further aspect of the disclosed technologies, provides that one of the registration walls, such as the leading edge registration wall 130, can be selectively moveable or removed. In this way, the wall 130 no longer prevents the sheet from moving beyond the leading edge of the media platen 100. The removal of one or both registration walls can be performed as the media platen 100 approaches a marking station or as marking assemblies are moved into proximity of the media platen. Additionally, one or both of the registration wall can be removed or moved out of the way when it is time to offload the sheet 5 from the platen 100.

Further, the pneumatic table 10 can be carried by a media sled to a marking zone. In this way, a printing system, such as an inkjet assembly can mark the substrate sheet 5 as it passes. Alternatively and/or additionally, a variety of devices for generating an image could be used. For example, xerographic, flexographic or lithographic image transfer systems could be employed.

Figure 7:
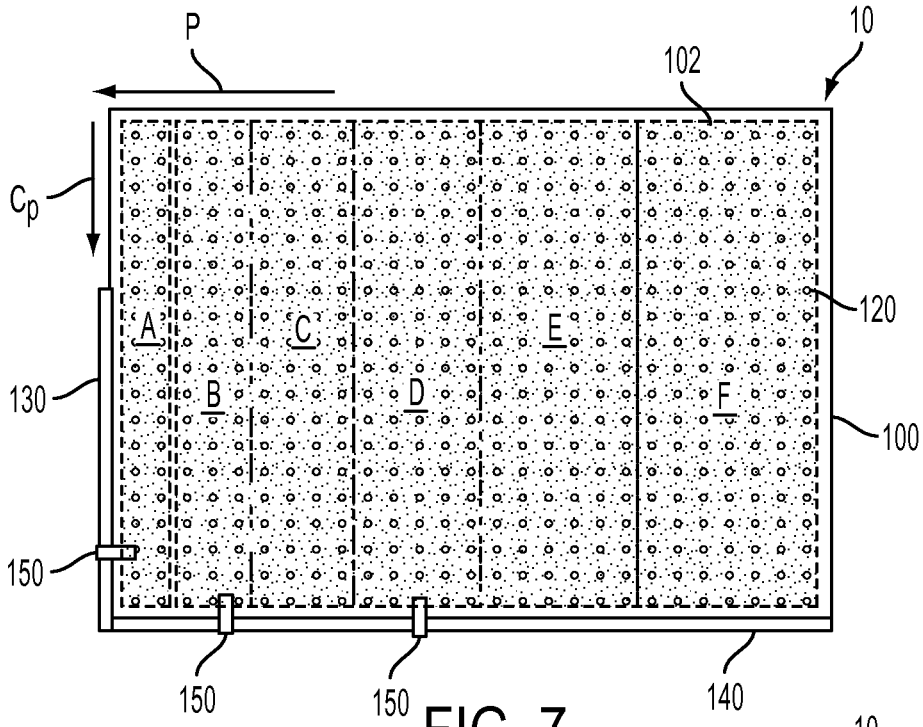
FIG. 7 is a plan view of a pneumatic table for registering and transporting a sheet of substrate media in accordance with a further aspect of the disclosed technologies.
Figure 8:
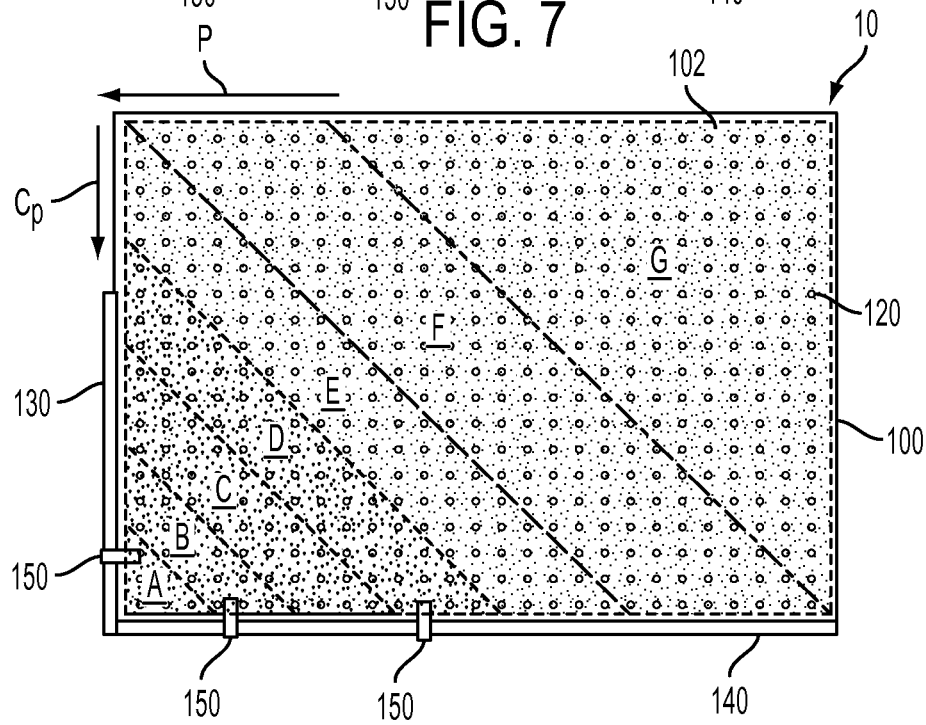
FIG. 8 is a plan view of a pneumatic table for registering and transporting a sheet of substrate media in accordance with yet a further aspect of the disclosed technologies.
Figure 9:
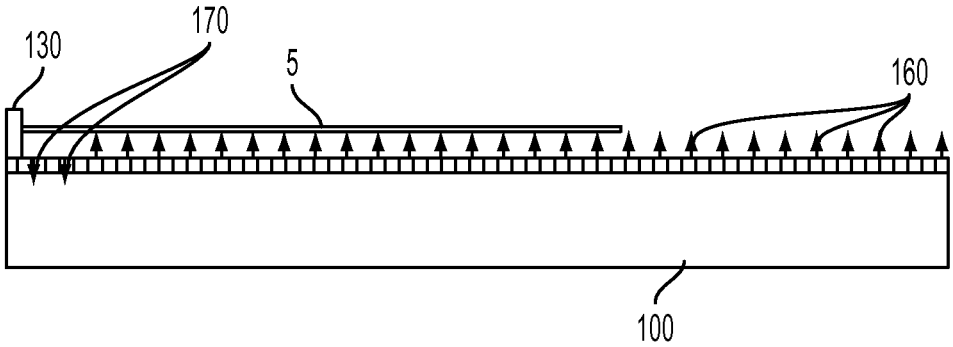
FIG. 9 is a side cross-sectional elevation view of the pneumatic table shown in FIG. 7 with negative airflow emitted from one initial zone of the table platen and positive airflow emitted from the remainder of the table platen in accordance with an aspect of the disclosed technologies.
Figure 10:
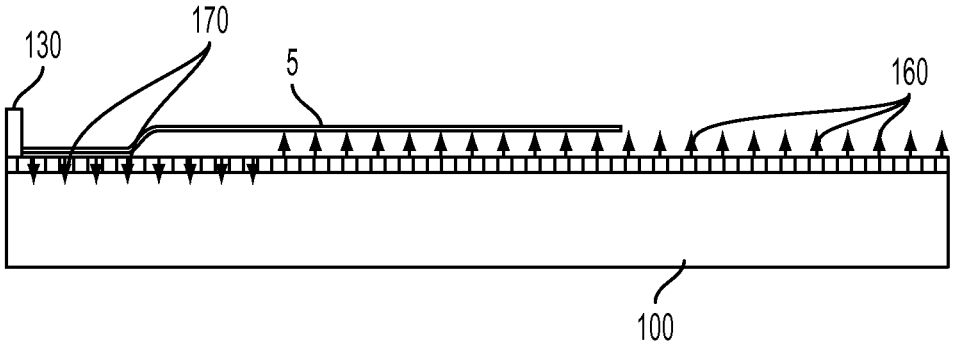
FIG. 10 is a side cross-sectional elevation view of the pneumatic table shown in FIG. 7 with negative airflow emitted from two initial zones of the table platen and positive airflow emitted from the remainder of the table platen in accordance with an aspect of the disclosed technologies.
Figure 11:
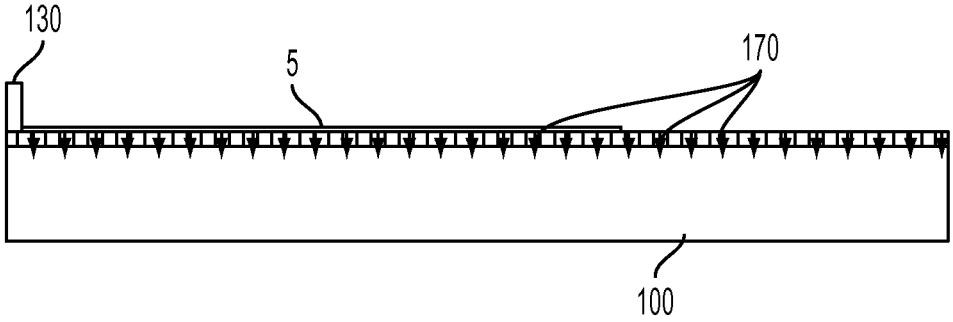
FIG. 11 is a side cross-sectional elevation view of the pneumatic table shown in FIG. 7 with negative airflow emitted across all zones of the table platen in accordance with an aspect of the disclosed technologies.

FIGS. 7-11 illustrate further methods of implementing the transition from positive 160 to negative 170 airflow from the foraminous upper surface 102. In particular, FIGS. 7 and 8 both show a stepped progression of zones (A-F and A-G, respectively) that are selectively controlled to individually either produce a positive airflow 160 or negative airflow 170. FIGS. 9-11 further illustrate such a stepped progression using a cross-sectional side elevation view across a process direction relative to the media platen 100. Initially all the zones A-F or A-G can provide a positive airflow 160. Once the substrate media sheet 5 is loaded on the platen and registered against both registration walls 130, 140, the airflow in the first zone A gets switched over to negative airflow 170, with the remaining zones still providing positive airflow 160, as shown in FIG. 9. This allows just an initial portion of the substrate sheet to get sucked-down onto the media platen, which can minimize sheet drift during the transition from positive to negative airflow. Thereafter, a next adjacent zone B would get switched over as shown in FIG. 10, enabling additional portions of the sheet 5 to get held-down. The progression would continue in an upstream direction until all zones are switched over as shown in FIG. 11. FIGS. 7 and 8 illustrate how different sets of apertures 120 can be grouped in order to alter how the progressive combination of negative/positive airflow engages the substrate media sheet 5. In this way, the zone configuration shown in FIG. 7 divides the zones across the cross-process direction, while FIG. 8 divides the zones diagonally extending in both a process direction and a cross-process direction. Also, both embodiments in FIGS. 7 and 8 show a progressive increase in the size of each zone from the process direction registration wall 130 toward the upstream direction. However, it should be understood that the zones can be divided differently. For example, each zone can have an equal number of apertures or some other division. Also, each zone can comprise a single row (in any direction) with other zones also including a single albeit different row of apertures. Further, the changes in zone size, if any, can be varied as desired.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A pneumatic table for registering and clamping thereon a sheet of substrate media for handling in a printing system, the pneumatic table comprising:

a media platen, the media platen having a foraminous upper surface for receiving a substrate media sheet;

a reversible air blower, the reversible air blower selectively generating at least one of a positive air flow and a negative airflow through the foraminous upper surface, wherein the positive air flow forms a gaseous layer of air between the foraminous upper surface and the substrate media sheet, the negative airflow encouraging the substrate media sheet to remain fixed and engaged upon the foraminous upper surface;

a registration wall extending along at least one edge of the foraminous upper surface; and a sheet biasing element, the sheet biasing element selectively applying a horizontal biasing force to the substrate media sheet encouraging movement of the substrate media sheet across the foraminous upper surface for engaging the substrate media sheet with the registration wall;

wherein the reversible air blower is configured to provide a progressive transition across the foraminous upper surface from positive air flow to negative air flow.

2. The pneumatic table as defined in claim 1, further comprising:

an edge sensor for detecting a position of the substrate media sheet, the edge sensor disposed along a portion of the registration wall for detecting whether the substrate media sheet has attained a target registration position.

3. The pneumatic table as defined in claim 1, wherein the registration wall extends along two adjoining edges of the foraminous upper surface.

4. The pneumatic table as defined in claim 1, wherein the registration wall extends continuously along the at least one edge substantially as long as at least one edge of the substrate media sheet.

5. The pneumatic table as defined in claim 1, wherein at least a portion of the registration wall is selectively moveable in order to allow the substrate media sheet to slide off the foraminous upper surface.

6. The pneumatic table as defined in claim 1, wherein the sheet biasing element includes a mechanical element directly engaging the substrate media sheet in order to encourage the movement thereof.

7. The pneumatic table as defined in claim 1, wherein the sheet biasing element engages the substrate media sheet on at least one edge of the sheet.

8. The pneumatic table as defined in claim 1, wherein the sheet biasing element engages the substrate media sheet on at least two different edges of the sheet.

9. A method of registering and securing a sheet of substrate media on a media platen for handling in a printing system, the method comprising:

loading a substrate media sheet onto a media platen, the media platen including a foraminous upper surface for engaging the substrate media sheet;

generating a positive flow of air through the foraminous upper surface, the positive flow of air forming a gaseous layer of air between the foraminous upper surface and the substrate media sheet;

applying a generally horizontal biasing force to the substrate media sheet at least partially suspended on the gaseous layer; and generating a negative flow of air through the foraminous upper surface, the negative flow of air encouraging the substrate media sheet to remain fixed and engaged upon the foraminous upper surface.

10. The method as defined in claim 9, wherein the negative flow of air is generated in response to the positive flow of air no longer passing through at least a portion of the foraminous upper surface that previously had the positive flow of air passing therethrough.

11. The method as defined in claim 10, wherein a virtually instantaneous transition is provided from the generation of the positive flow of air to the generation of the negative flow of air.

12. The method as defined in claim 10, wherein a progressive transition across the foraminous upper surface is provided from the generation of the positive flow of air to the generation of the negative flow of air.

13. The method as defined in claim 10, wherein the negative flow of air is generated in response to an indication by a sensor that the substrate media sheet has engaged a registration wall extending along at least one edge of the foraminous upper surface.

14. The method as defined in claim 13, wherein the registration wall engagement includes the substrate media engaging two extents of the registration wall, the two extents of the registration wall being disposed along two adjoining edges of the foraminous upper surface.

15. The method as defined in claim 9, wherein the generally horizontal biasing force is applied by a mechanical element directly engaging the substrate media sheet in order to encourage the movement thereof.

16. The method as defined in claim 9, wherein the generally horizontal biasing force engages at least one edge of the substrate media sheet.

17. The method as defined in claim 16, wherein the generally horizontal biasing force engages at least two edges of the substrate media sheet.

18. The method as defined in claim 9, wherein the progressive transition includes switching select regions of the foraminous upper surface separately from positive to negative flow of air.

* * * * *